United States Patent [19]

Wells

[11] 4,039,100

[45] Aug. 2, 1977

[54] CONTAINER HAVING NON-REMOVABLE OPENING MEMBER WITH ATTACHED OPENING LEVER

[76] Inventor: Robert A. Wells, 4450 Harris Trail NW., Atlanta, Ga. 30327

[21] Appl. No.: 709,439

[22] Filed: July 28, 1976

[51] Int. Cl.[2] ..... B65D 41/32

[52] U.S. Cl. ..... 220/269; 220/267

[58] Field of Search ..... 220/269–273, 220/267, 268

[56] References Cited

U.S. PATENT DOCUMENTS

| | | | |
|---|---|---|---|
| 3,403,811 | 10/1968 | Moller et al. | 220/273 |
| 3,532,248 | 10/1970 | Ruekberg | 220/270 |

*Primary Examiner*—George T. Hall

[57] ABSTRACT

Easy-opening container wall structure having a non-removable and selectively separable openable member to which is attached an opening tab member. A portion of the opening tab member can be manually displaced outwardly from the container wall, thereby forcing another portion of the opening tab member against the container wall to initiate separation of the openable member. The opening tab member thereafter transmits inwardly-directed manual pressure to complete separation of the openable member, and to retain the opening tab member from unrestricted movement into the container. The periphery of the separated openable member co-acts with the periphery of the opening in the container wall to retain the separated openable member on the container.

8 Claims, 14 Drawing Figures

CONTAINER HAVING NON-REMOVABLE OPENING MEMBER WITH ATTACHED OPENING LEVER

This invention relates in general to container structure and in particular to an easy-opening container for beverages or the like.

The popularity of the conventional pop-top beverage container has caused the problem of littering resulting from improper disposal of the tear tab that is detached to open the container. These removable tear tabs, which typically have sharp or rough metal edges, are frequently dropped on the ground as soon as the can is opened, thereby creating an unsightly and hazardous situation. Public criticism and dissatisfaction with the conventional pop-top beverage can, with its removable tear tab, has increased to the point where a number of jurisdictions have outlawed such beverage containers or are contemplating doing so.

A preferred solution to the problems created by the conventional pop-top would be an easy-opening container which is manually operable by children as well as adults, which provides an effective pouring opening once opened, which presents no psychological barriers to opening or beverage consumption, which is readily producible, and which is economically feasible. While many designs of easy-opening containers have been proposed as substitutes for the conventional pop-top, none is known which effectively meets all of the foregoing criteria to the satisfaction of the container manufacturer, the beverage packager, and the consumer of canned beverages.

Accordingly, it is an object of the present invention to provide an improved easy-opening container.

It is another object of the present invention to provide an easy-opening container which is openable with manual force.

It is still another object of the present invention to provide an easy-opening container which can be manufactured with conventional scoring techniques.

Stated in general terms, the easy-opening container of the present invention includes an openable member defined in a container wall by a selectively separable region of weakness, with a separate opening tab member secured to the openable member on the outer side of the container wall. The opening tab member, which overlies at least part of the separable region, is attached to the openable member so as to be bendably movable about a fulcrum relative to the openable member. As a first portion of the opening tab member is manually moved away from the wall, the opening tab member bends about the fulcrum to move a second portion inwardly into contact with the container wall in the vicinity of the separable region, thereby initiating fracture of the separable region. The remainder of the separable region is fractured by a subsequent downward force against the opening tab member and the overhanging portion of the opening tab member supports the opening tab member and now-separated openable member for slidable displacement along the container wall to expose the opening in that wall.

Other advantages and objects of the present invention will become more readily apparent from the following description of the disclosed embodiments, including the drawing in which.

Figure 1:
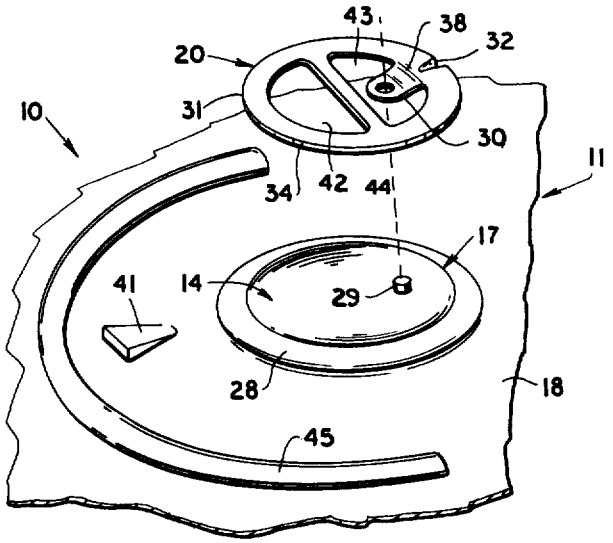
FIG. 1 shows an exploded fragmentary pictorial view of a beverage container equipped according to a disclosed embodiment of the present invention.

Turning to the embodiment shown in FIGS. 1–4, there is generally at 10 a beverage container including an end wall 11 surrounded by a chime 12 which connects the end wall with the cam body 13. An openable member 14 is defined in the end wall 11 by the continuous selectively separable region 17 formed in the outer surface 18 of the end wall. The separable region 17, as is known to those skilled in the art, provides a region of predetermined structural weakness which is formed in the end wall 11. The separable region can be provided by a score line which is coined or otherwise formed in the wall in a manner known to those skilled in the art. The score line may extend only partially through the thickness of the wall 11, or may alternatively be a "repaired score" in which the openable member 14 is initially severed from the wall 11 and then reconnected to the wall by applying a suitable sealing material along the line of separation of the inside surface 18*a* of the wall. The selectively separable region associated with the easy-opening structure of the present invention, including the separable region 17 and like regions of other disclosed embodiments of the present invention, are hereinafter identified as a "separable region" irrespective of the design of the separable region or the manufacturing technique used to form the region.

Figure 2:
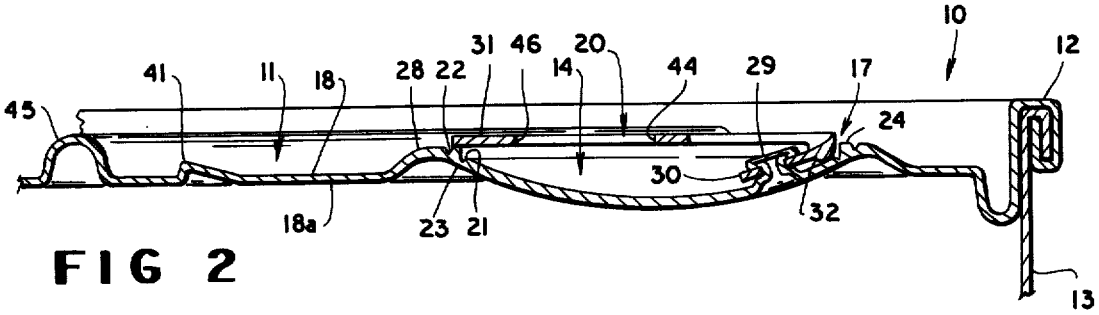
FIG. 2 shows an elevation sectioned view of the assembled embodiment shown in FIG. 1, before opening.

As best shown in FIG. 2, the separable region 17 in the embodiment of FIGS. 1–4 is provided by a continuous fracturable score line 21 which is surrounded by the continuous non-fracturable score line 22. The inner or fracturable score line 21 provides a fracturable web 23 of metal between the bottom of the fracturable score line and the inside surface 18*a* of the end wall 11. The outer score line 22 weakens the metal of the end wall 11 sufficiently to define an annular rim 24 which, when subjected to force directed downwardly against the wall 11 at a location in the vicinity of the separable region 17, undergoes flexure sufficient to break the fracturable web 23 associated with the fracturable score line 21.

The separable region 17 is disposed on an annular rim 28 which is raised slightly above the other surface 18 of the end wall 11, and the openable member 14 is generally concave relative to the annular rim 28. As shown below, however, concavity of the openable member 14 is not a requirement of the present invention.

An opening tab member shown at 20 is attached to the openable member 14 by any suitable fastening technique, such as the rivet 29 which is formed in the openable member and extends through an opening in the attachment member 30 which forms an integral part of the openable tab member. The openable tab member 30 has an annular rim 31 which overlies at least a substantial portion of the separable region 17 on the end wall 11, as best seen in FIG. 2. A protrusion 32 is formed on the underside of the annular rim 31 at the back end 33 of the opening tab member 20. The protrusion 32 contacts the openable member 14 just inside the angular fracturable score line 21 and is aligned with the attachment member 30, which extends into the open area 43 from the annular rim 31 to the attachment with rivet 29. Although the protrusion 32 is shown in FIG. 2 as being inside of the score line 21, the protrusion may alternatively be positioned to contact the annular rim 24 or the non-fracturable score line 22; it is only necessary that the protrusion 32 be in actual or proximate contact in the vicinity of the separable region 17.

Figure 3:
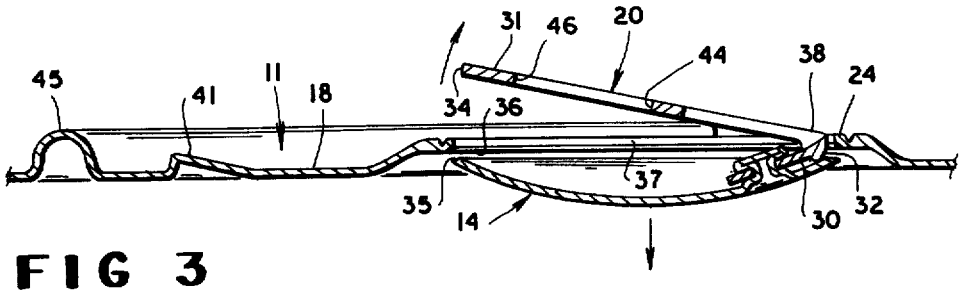
FIG. 3 shows an elevation sectioned view as in FIG. 2, immediately after fracturing the separable region.

The openable member 14 of the embodiment depicted in FIGS. 1–4 is opened by initially lifting the forward end 34 of the opening tab member 20 a distance outwardly from the end wall 11, as shown in FIG. 3, so that the opening tab member bends about a fulcrum 38 which is provided by the attachment member 30. It is desirable in the present embodiment that the bending movement be elastic, so that the opening tab member 20 returns at least approximately to the position initially occupied in FIG. 2 upon being released from the position shown in FIG. 3, and so the attachment member 30 is preferably constructed to undergo an extent of bending movement without becoming permanently deformed. As the opening tab member 20 is manually raised to the position shown in FIG. 3, the protrusion 32 is forced downwardly against the end wall 11 to apply concentrated force to a location in the vicinity of the separable region 17, so that the separable region is fractured in proximity to the location of stress concentration provided by the downwardly-urged protrusion. The opening tab member 20 is now released and allowed to return to the initial position shown in FIG. 2, whereupon thumb or finger pressure applied downwardly onto the annular rim 31 of the opening tab member causes the initial fracture of the separable region to propagate throughout the remaining unfractured portions of that region. The openable member 14 is now completely separated from the remainder of the end wall 11, as shown in FIG. 3.

It is seen in FIG. 3 that the separated openable member 14 has a peripheral edge 35 which underlies the periphery 36 of the opening 37 formed in the end wall 11 by fracture of the separable region 17. This underlying arrangement of the peripheral edge 35, which is provided by scoring techniques known to those skilled in the art, prevents the openable member 14 from being withdrawn through the opening 37 so that the openable member and the attached opening tab member 20 are retained to the end wall 11 and cannot be separated from the container 10 for improper disposal.

Figure 4:
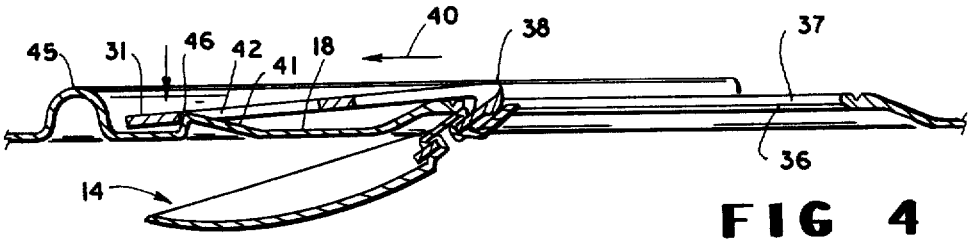
FIG. 4 shows an elevation sectioned view as in FIG. 3, in fully opened configuration.

After the openable member 14 has been separated from the remainder of the end wall 11 as described above, the opening tab member 20 is slidably displaced along the outer surface 18 of the end wall by thumb pressure in the direction shown by the arrow 40, FIG. 4, so that the opening tab member and the attached openable member are laterally displaced along the outer surface and the inside surface, respectively, of the end wall to leave the opening 37 substantially exposed. A locking projection 41 may advantageously be formed on the outer surface 18 of the end wall 11, in position to ride beneath the forward end 34 of the opening tab member to engage a surface 46 of the opening 42 in the opening tab member 20 when the opening tab member is moved to the fully-opened position depicted in FIG. 4. This locking projection thus prevents the opening tab member from unwanted movement while a beverage is poured or consumed from the opened container 10.

The opening tab member may have substantially the configuration of a ring formed by the previously-mentioned opening 42 and the opening 43 within the annular rim 31, thereby reducing the amount of metal needed to form the opening tab member. It may be desirable to strenthen the opening tab member by providing a laterally-extending strip of metal 44 which bridges the annular rim 31 between the forward end 34 and the attachment member 30.

Since a number of separate end walls 11 are typically stacked in a nesting relationship during end wall production and during subsequent canning operations, it may be desirable to form the extended smile bead 45 extending outwardly in the outer surface 18 of the end wall 11. This smile bead 45, best seen in FIG. 2, preferably extends outwardly substantially to the elevation of the opening tab member 20, relative to the outer surface 18 of the end wall, and effectively receives most or all of the weight of other end walls which may be stacked on a particular end wall, thereby eliminating or greatly reducing the possibility that the separable region 17 can be inadvertenly fractured by the weight of other end walls in a vertical stack.

Figure 5:
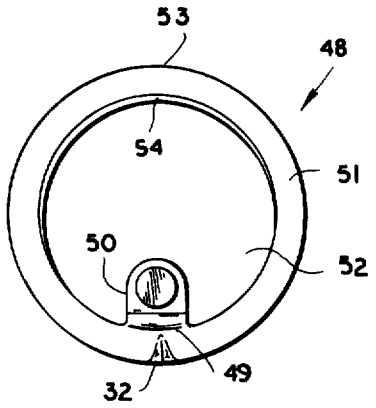
FIG. 5 shows a plan view of an opening tab member according to another disclosed embodiment of the present invention.
Figure 6:
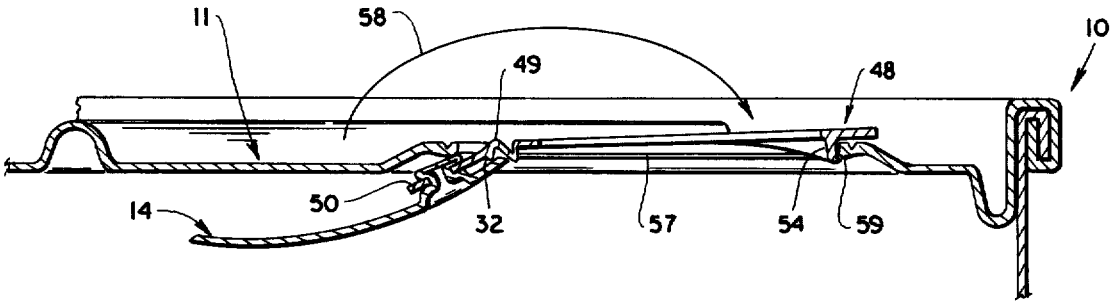
FIG. 6 shows an elevation sectioned view of a fully-opened container using the opening tab member of FIG. 5.

The embodiment shown in FIGS. 5 and 6 also has an openable member 14 which is formed in an end wall 11 by a separable region. The embodiment of FIGS. 5 and 6 differs from the preceding embodiment, however, in that the opening tab member 48 is attached to the openable member 14 by a yieldably bendable connection 49. This yieldably bendable connection may be provided at the root of the attachment finger 50 which extends into the open interior 52 formed by the ring-like annular rim 51 of the opening tab member. A skirt 54 is formed on the inner periphery of the ring opening 52, at least along the portion of the opening periphery which is adjacent to the forward end 53 of the opening tab member. This skirt 54 extends outwardly from the opening tab member, while the opening tab member is attached to the openable member of an unopened container. The downwardly-extending protrusion 32, previously discussed in the preceding embodiment, is formed in the back end of the annular rim 51.

A container equipped with the easy-opening structure of FIGS. 5 and 6 is initially opened by lifting the forward end 53 of the opening tab member upwardly to force the protrusion 32 downwardly to fracture the separable region 17. The annular rim 51 is next pressed downwardly to contact the end wall in the vicinity of the separable region 17 to fracture the remainder of the separable region. The opening tab member 48 and attached member 14 is then slidably moved away from the opening formed in the container, to occupy a position similar to that shown in FIG. 4. At this time, the opening tab member 48 can be manually rotated approximately 180°, as indicated by the arrow 58 in FIG. 6, to place the ring opening 52 in substantial alignment with the opening 57 in the end wall 11. The skirt 54 enters the end wall and preferably engages the confronting periphery 59 of that opening, to align the ring and end walls openings and to retain the opening tab member 48 in position on the row-opened end wall. The annular rim 51 of the opening tab member thus surrounds the periphery of the opening 57 and reduces the likelihood of injury resulting from accidental contact with the rough or sharp edge 59 of the opening 57.

Figure 7:
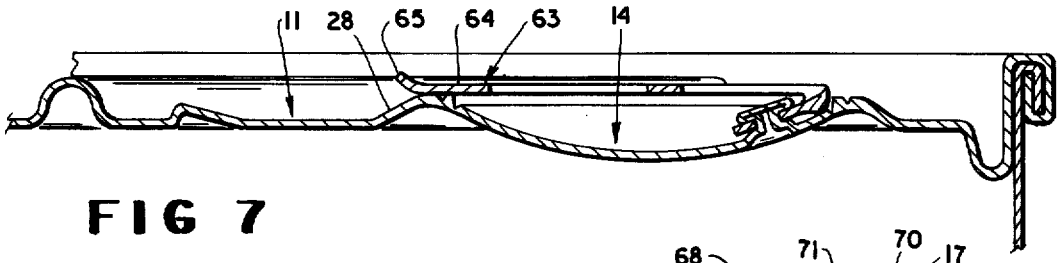
FIG. 7 is a sectioned view showing a modified embodiment of the opening tab member of the present invention.

The embodiment of FIG. 7 shows a modified opening tab member 63 which may be substituted for the opening tab members used in the other described embodiments of the present invention. The opening tab member 63 has an annular rim 64 with a forward end 65 which extends slightly beyond the annular rim 64, and which is upturned slightly to facilitate grasping and moving the forward end outwardly from the end wall 11 to initiate the opening procedure.

Figure 7A:
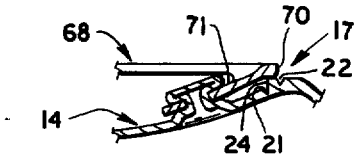
FIG. 7A is a fragmentary sectioned view showing an example of alternative placement of the protrusion which contacts the container wall in the vicinity of the separable region.

The modified opening tab member 68 of FIG. 7A shows an alternative arrangement for applying downwardly-directed force in the vicinity of the separable region 17. The back end 70 of the opening tab member 68 rests on the annular rim 24 which lies between the fracturable score line 21 and the non-fracturable score line 22. When the forward end (not shown) of the opening tab member 68 is moved outwardly from the end wall, the opening tab member pivots about a fulcrum provided by the attachment member 71 and forces the back end 70 of the opening tab member downwardly onto the annular rim 24, thereby deflecting the annular rim sufficiently to fracture the score line 21. As stated previously, it is relatively unimportant where the back end of the opening tab member contacts the end wall so long as such point of contact is in the vicinity of the separable region 17 so as to impart flexure sufficient to initiate fracturing of the separable region.

Figure 8:
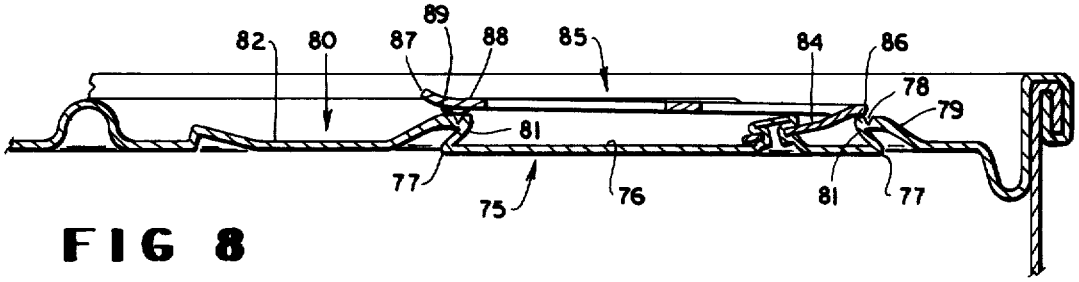
FIG. 8 is a sectioned view showing still another embodiment of the present invention, in a closed figuration.

The embodiment shown in FIG. 8 utilizes an openable member 75 which may have a substantially flat body 76 surrounded by and unitary with the peripheral edge 77, which underhangs the separable region 78 formed at an upper portion of the annular rim 79 which is raised above the outer surface 82 of the end walls 80. Since the peripheral edge 77 of the openable member 75 underhangs the separable region 78, that separable region need not have any particular configuration which fractures to retain the openable member 75 on the end wall 80. The separable region 78 may, accordingly, be a conventional score line coined, stamped, or otherwise formed in the end wall. The openable member 75 includes a unitary annular portion 81 which extends inwardly from the peripheral edge 77 at an acute angle to overlie the periphery of the openable member body 76, a construction which can be produced by crush-scoring techniques known to those skilled in the art. The separable region may alternatively be formed at the peripheral edge 77, or at the peripheral edge 83 where the portion 81 joins the annular rim 79.

An opening tab member 85 is attached to the openable member 75 by way of the attachment means 84, which provides a bendable fulcrum about which the back end 86 of the opening tab member is forced downwardly against the separable region 78 as the front end 87 of the openable tab member is manually lifted. After initiating fracture of the separable region 78 in the foregoing matter, the remainder of the separable region is fractured by pressing downwardly against the annular rim 88 of the opening tab member which overlies and contacts the separable region. The opening tab member 85 may be provided with one or more dimples 89 which extend downwardly from the annular rim 88 to contact the end wall 80 in the vicinity of the separable region 78. The dimples concentrate the downward force which is manually applied to the opening tab member to complete the fracture of the separable region. Of course, the opening tab members of the other embodiments disclosed herein can also be provided with dimples similar to the dimple 89 shown in FIG. 8.

Figure 9:
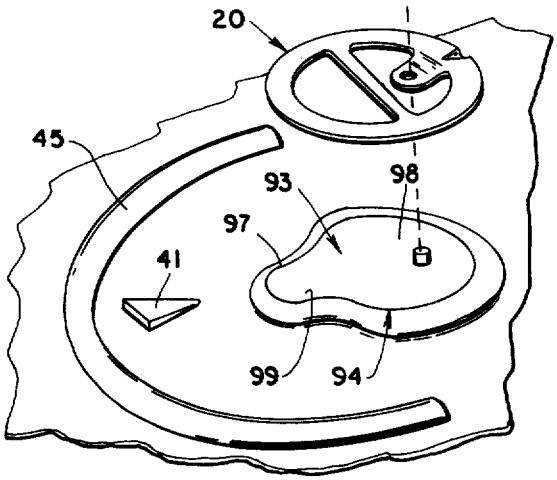
FIG. 9 is a fragmentary exploded view of still another disclosed embodiment of the present invention.
Figure 10:
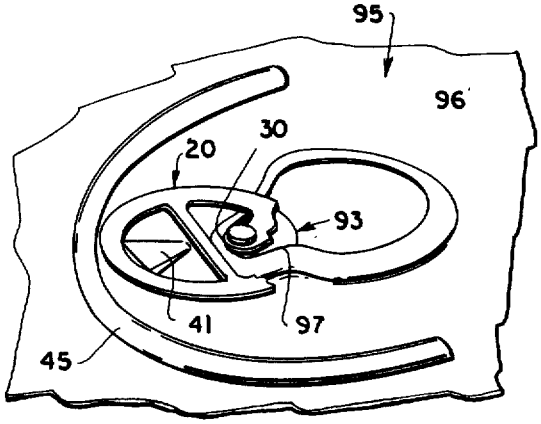
FIG. 10 is an assembled pictorial view, partially broken away for illustrative purposes, of the embodiment of FIG. 9 in fully-opened position.

The embodiment depicted in FIGS. 9 and 10 differs from the previously described embodiments by having the openable member 93 in an irregular shape which, upon separation of the separable region 94, provides an end wall opening 96 having a recessed area 97 for receiving the attachment member of the opening tab member. The openable member 93 has a first relatively large area 98, which is preferably located on the end wall 95 close to the chime of the container to facilitate drinking or pouring the container contents, and a contiguous second area 99. The first area 98 of the openable member 93 depicted in FIG. 9 is a circular segment, although a circular shape is not essential. The second area 99 of the openable member is narrower than the maximum diameter of the first area 98, and is elongated in a direction toward the center of the end wall 95.

Referring to FIG. 10, it is assumed that the separable region 94 has been completely fractured in the manner described above so that the opening tab member 20 and attached openable member 93 have been slidably displaced to expose the opening 96 in the end wall 95. The second area 97 of the opening provides a channel at least sufficiently wide to receive the attachment member 30, so that substantially that portion of the opening 96 formed by the first area 98 of the openable member is exposed for pouring or drinking the contents of the container.

Figure 11:
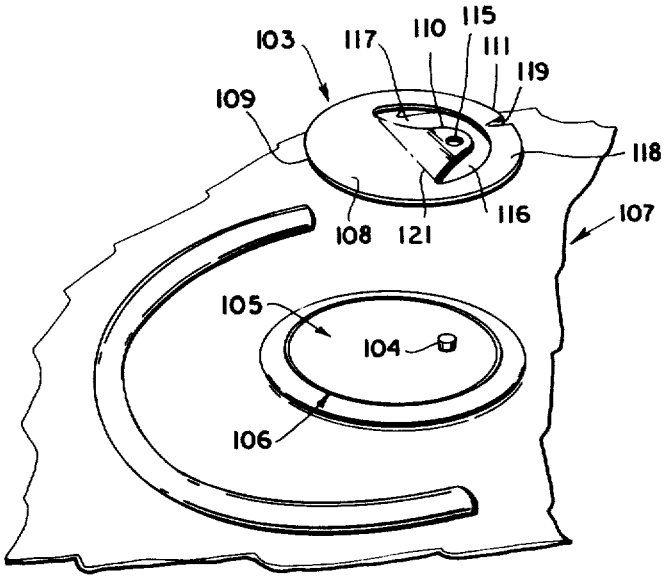
FIG. 11 is a fragmentary exploded view of another disclosed embodiment of the present invention.
Figure 12:
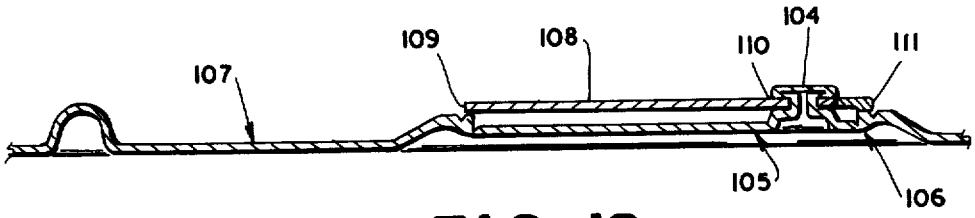
FIG. 12 is a sectioned view showing the assembled embodiment of FIG. 11 in a closed position.
Figure 13:
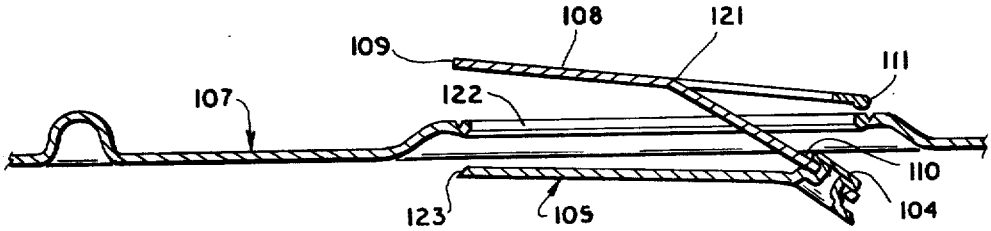
FIG. 13 is a sectioned view showing the embodiment of FIG. 11 in an intermediate stage of opening.

Although the previously-described embodiments of the present invention utilize an opening tab member which provides bendable movement between a point of attachment (such as the rivet 29 of FIG. 1) and the adjacent separable region, the embodiment of FIGS. 11–13 provides bendable movement about a fulcrum which is located on the interior of the openable tab member, relative to the rivet 104 or other attachment to the openable member 105. The openable member 105, which may either be substantially circular as shown in FIG. 11 or which may alternatively have an irregular shape as shown in FIGS. 9 and 10, is defined by a separable region 106 in the end wall 107 of a container. The opening tab member 103, which is also substantially circular in the depicted embodiment, has a solid semicircular portion 108 extending inwardly from the forward edge 109, and terminating in the integrally-formed attachment member 110 which is located off-center on the opening tab member toward the back edge 111 thereof. The attachment member 110 contains an opening 115 to receive the rivet 104 on the openable member 105. Since the openable member 105 is substantially flat as best seen in FIG. 12, the attachment member 110 of the disclosed embodiment can be coplanar with the remainder of the opening tab member 103 and need not be deformed downwardly to conform with the contour of the openable member. The attachment member 110 is further defined by the cut-away regions 116 and 117 which flank the attachment member to define the semicircular annular rim portion 118 of the opening tab member. A downwardly-extending protrusion 119 is formed at the back edge 111 of the rim portion, for engagement in the vicinity of the separable region 106 as best seen in FIG. 12.

The embodiment shown in FIGS. 11-13 is opened in the following manner. The forward edge 109 of the opening tab member is manually lifted upwardly from the end wall 107, causing the opening tab member to bend about a fulcrum 121 which is proximately defined by the maximum point to which the cut-away portions 116 and 117 extend toward the forward edge 109 of the opening tab member. The bending movement about the fulcrum 121 forces the protrusion 119 of the back edge 111 downwardly against a location in the vicinity of the separable region 106, thereby initiating fracture of the separable region. The forward edge 109 of the opening tab member is now released, so that the opening tab member can be pressed downwardly against the separable region 106 to accomplish complete fracture of that region. An opening 122 is thus formed in the end wall 107, and the separable region 106 is preferably configured so that the periphery 123 of the separated openable member 105 underlies the periphery of the opening 122 to retain the separated openable member on the end wall. The opening tab member 103 is supported on the end wall 107 for slidable movement to displace the openable tab member and attached opening member out of position with respect to the opening 122, thereby permitting access to the contents of the container.

It should be understood that the foregoing relates only to disclosed embodiments of the present invention, and that numerous modifications and alterations may be made therein without departing from the spirit and scope of the invention as defined in the following claims.

I claim:

1. Easy opening wall apparatus for a container, comprising:

a wall having an outer side and an inner side;

an openable member smaller than said wall and defined in said wall by a selectably separable region of. weakness completely surrounding said openable member;

a separate opening tab member secured to the outer side of said openable member and overhanging at least a sufficient portion of said separable region to engage said outer side of said wall and prevent said opening tab member and said attached openable member from freely entering the container through said wall upon separation of said separable region, said opening tab member having a first portion which is manually movable outwardly away from said outer side to move a second portion of the opening tab member inwardly to contact said wall in the vicinity of said separable region and fracture said separable region; and means operative to retain said openable member on said wall when said separable region has become separated.

2. Easy opening wall apparatus for a container, comprising:

a wall having an outer side and an inner side;

an openable member defined in said wall by a selectably separable region of weakness completely surrounding said openable member;

a separate opening tab member secured to the outer side of said openable member and overhanging at least a portion of said separable region;

said opening tab member having a first portion which is manually movable outwardly away from said outer side to move second portion of the opening tab member inwardly to contact said wall, in the vicinity of said separable region and fracture said separable region, said opening tab member comprising a ring having an outer portion which substantially overhangs said separable region; and an attachment portion which extends inwardly from said outer portion and which is secured to said openable member; and said attachment portion being bendably connected to said outer portion to provide a fulcrum about which said second portion moves inwardly as said first portion is manually moved outwardly.

3. Apparatus as in claim 2, wherein said attachment portion is elastically bendable to allow said opening tab member to elastically return to an initial position on said wall after released from said manual movement.

4. Apparatus as in claim 2, wherein said attachment portion is deformably bendable to allow said opening tab member to be permanently displaced from an initial position overhanging said separable region.

5. Apparatus as in claim 4, further comprising:

means on said opening tab member to define a ring opening which is positionable in alignment with said wall opening by deformably bending said attachment portion; and means on said opening tab member to retain said ring in alignment with said wall opening.

6. Easy opening wall apparatus for a container, comprising:

a wall having an outer side and an inner side;

an openable member defined in said wall by a selectably separable region of weakness completely surrounding said openable member;

said openable member having means which underhangs at least a peripheral portion of the opening formed in said wall by said separable region, so that said openable member cannot be withdrawn through said opening;

a separate opening tab member secured to the outer side of said openable member and overhanging at least a portion of said separable region;

said opening tab member having a first portion which is manually movable outwardly away from said outer side to move a second portion of the opening tab member inwardly to contact said wall in the vicinity of said separable region and fracture said separable region; and said overhang of opening tab member supporting said opening tab member for translational movement along said outer side of said wall upon separation of said separable region, so that said opening tab member and the separated openable member can be displaced to expose an opening in said wall.

7. Easy opening wall apparatus for a container, comprising:

a wall having an outer side and an inner side;

an openable member defined in said wall by a selectably separable region of weakness completely surrounding said openable member;

a separate opening tab member secured to the outer side of said openable member and overhanging at least a portion of said separable region;

said opening tab member having a first portion which is manually movable outwardly away from said outer side to move a second portion of the opening tab member inwardly to contact said wall in the vicinity of said separable region and fracture said separable region;

said opening tab member having an attachment portion which is attached to said openable member; and said attachment portion being elastically bendable to permit said openable tab member to return substantially to an initial position overlying said separable region, upon release of said manual movement.

8. Easy opening wall apparatus for a container, comprising:

a wall having an outer side and an inner side;

an openable member defined in said wall by a selectably separable region of weakness completely surrounding said openable member;

a separate opening tab member secured to the outer side of said openable member and overhanging at least a portion of said separable region;

said opening tab member having a first portion which is manually movable outwardly away from said outer side to move a second portion of the opening tab member inwardly to contact said wall in the vicinity of said separable region and fracture said separable region;

said openable member having a first area which defines an access opening in said wall upon separation of said separable region, and a second relatively smaller area contiguous to said first area; and said second area being configured to provide an opening to receive said attachment portion of said opening tab member after said separable region is separated so that said opening tab member and the attached separated openable member can be slidably displaced along said wall to expose substantially all of said access opening.

* * * * *